United States Patent [19]

Greiner, Jr. et al.

[11] 4,135,675

[45] Jan. 23, 1979

[54] PAPER CARRIER STRIPPING METHOD AND APPARATUS

[75] Inventors: William A. Greiner, Jr.; Richard J. Evans, both of Lancaster, Pa.

[73] Assignee: Armstrong Cork Company, Lancaster, Pa.

[21] Appl. No.: 802,308

[22] Filed: Jun. 1, 1977

[51] Int. Cl.[2] ..... B65H 17/02

[52] U.S. Cl. ..... 242/67.1 R

[58] Field of Search ..... 242/67.1 R, 67.3 R, 242/55, 86, 52, 75.1, DIG. 3, 68.7, 75.3, 75, 69.2; 156/247, 344, 584

[56] References Cited

U.S. PATENT DOCUMENTS

| | | | |
|---|---|---|---|
| 1,737,127 | 11/1929 | Richey | 242/67.3 R |
| 2,336,754 | 12/1943 | Schelhammer et al. | 242/55 |
| 3,457,137 | 7/1969 | McCarthy | 156/344 |

*Primary Examiner*—George F. Mautz

[57] ABSTRACT

A flooring product is made on a paper carrier and the paper carrier is removed from the flooring just prior to the time the flooring is rolled up. The paper carrier, which is free from the flooring, is wrapped up with the roll of flooring to prevent adhesion between the flooring surfaces in the roll and to provide some physical stability to the roll of flooring when it is standing on its end.

2 Claims, 1 Drawing Figure

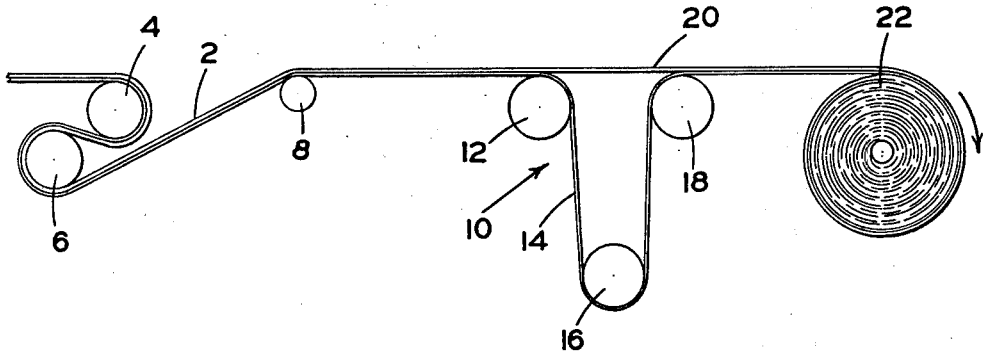
4
2
20
22
8
12
18
10
14
6
16

PAPER CARRIER STRIPPING METHOD AND APPARATUS

BACKGROUND OF THE INVENTION

1. Field of the Invention

The invention is directed to a floor covering manufacturing technique and, more specifically, to a means of moving a carrier from the flooring just prior to the time that the flooring is rolled up in a controlled condition.

2. Description of the Prior Art

It is old in the art to make an unbacked, decorative thermoplastic vinyl resin-containing surface covering (flooring) having a self-induced tension. This product is manufactured by fusing a vinyl resin composition decorative layer and a vinyl resin composition backing layer to a strippable, dimensionally stable backing to form a fused, thermoplastic decorative surface covering. The strippable backing is removed from the surface covering, and the surface covering is rolled, placing the surface covering under tension and thereby elongating the outward facing layer and compressing the other layer of the flooring. The composition and structure of the outward facing layer is such that, on unrolling the surface covering, the elongated layer overcomes the compressed layer and the surface covering is stretched to a dimension greater than its original unrolled dimension. On securing the surface covering at its periphery only, the tendency of the surface covering to return to its original dimension, that is, its elastic memory, creates a self-induced tension therein.

The strippable backing must be removed from the flooring so as to permit the rolling up of the flooring to create the desired tension within the surface covering in the roll. The removing of the strippable backing must be carried out in such a manner that the tension placed in the rolled up flooring can be controlled and that the backing may serve an additional purpose of being a protective layer between the surfaces of the surface covering in its rolled up state.

BRIEF DESCRIPTION OF THE DRAWING

The drawing is a schematic illustration of the apparatus for carrying out the inventive technique herein.

DESCRIPTION OF THE PREFERRED EMBODIMENT

A carrier, such as paper or felt carrying a release coating thereon, is coated with a first layer vinyl resin-containing coating which may be compounded to the degree required to give it the desired compression or elongation characteristics after which a separate, distinct decorative second layer vinyl resin-containing coating is applied thereover and the whole consolidated and fused to form two distinct thermoplastic vinyl resin-containing layers. As the resins used, it is preferred to use plasticized poly(vinylchloride), either the homopolymers or copolymers customarily used in the manufacture of decorative thermoplastic coverings of the type currently commercially available, and we have found that we may form these layers with conventional plastisols and/or dryblending resin formulations. The only critical factor is that adjustments must be made to the thickness of the two distinct layers and adjustments between resins, fillers, plasticizers, etc. used in formulating so as to achieve the desired results when the sheet is rolled, whereby the outward facing layer is stretched and the other layer compressed when the sheet is in a rolled form. The several parameters must be adjusted such that, when the sheet is rolled, the outward facing one vinyl layer is stretched to a degree less than, equal to or greater than the degree to which the other vinyl layer is compressed. That is, the outward facing layer dimension is stretched about the same degree the other layer dimension is compressed. The dimensional change of the stretching compared to the compression at the same point need not be the same, but can be more or less the same. When the sheet or surface covering is unrolled, the elongated layer must overcome the compressed layer such that the surface covering is initially stretched to a dimension greater than its original unrolled dimension. Respective layers may be so designed that the sheet may be rolled when the decorative layer facing outward or inward in the roll depends on the elongation and compressive characteristics of said layers.

After the thermoplastic sheet surface covering has been formed in accordance with this invention, it must be stripped in a controlled manner from the strippable carrier and rolled so that stresses are uniformly built into the sheet by the above-described stretching and compressing forces acting on the layers while the sheet is in its rolled form.

As is the usual custom, the sheet is shipped to the installation site where it is unrolled, cut to size and installed. When the sheet is installed, and before the stresses therein are relieved, by securing the sheet along the periphery thereof on only the surface to be covered, the stresses set up in the sheet create a built-in, selfinduced tension such that the sheet is uneffected even when on a wood substrate that is subject to a fluctuating environment and remains flat on the surface over which it is installed.

The following examples illustrate specific embodiments of the invention. In the examples, PVC means poly(vinyl chloride) and MW means average molecular weight.

EXAMPLE 1

A carrier is coated with a release coating and dried. This release coating is applied to the carrier using a forward roll coater and then air dried.

| Release Coat | |
|---|---|
| Ingredient | Parts by Weight |
| Methocel, 15 cps. (Methyl Cellulose) | 525 |
| Water | 5272 |
| Crushed Ice | 800 |
| Polyglycol P-1200 (Polypropylene Glycol MW-1200) | 7.4 |
| White Pigment ($T_1O_2$) | 65.0 |
| Green Pigment (Iron Nitroso Beta Naphthol Pulp) | 35.0 |

Seven mils of a filled plastisol base coat are applied to the release coated carrier using a reverse roll coater. This coating is then gelled in an oven to 290° F.

| Ingredient | Parts by Weight |
|---|---|
| Tenneco 1732 (Dispersion PVC Homopolymer Resin MW-106,000) | 625.0 |
| Diamond PVC-71 (PVC Homopolymer Resin MW-139,000) | 625.0 |
| Tenneco 501 (Blending Resin MW-95,300, Poly(vinyl chloride - vinyl acetate) Copolymer Resin - 95.5% vinyl chloride, 4.5% vinyl acetate) | 1250.0 |

-continued

| Ingredient | Parts by Weight |
|---|---|
| DOP (Di-2-Ethylhexyl phthalate) | 400.0 |
| White Paste (50/50 DOP/$T_1O_2$) | 249.0 |
| Black Pigment (Carbon black) | 1.0 |
| Drapex 4.4 (Octyl Epoxy Tallate) | 125.0 |
| TXIB (2-2-4 Trimethyl-1,3 Pentanediol Monoisobutyrate ester) | 250.0 |
| V-1366 (Ba. Ca. Zn. Phosphite) | 125.0 |
| Peg 200 (Polyethylene Glycol Monolaurate) | 50.0 |
| Camel Carb. (Calcium Carbonate) | 1000.0 |
| SMS (Mineral Spirits) | 62.5 |

Twenty-one mils of plastisol foam are applied on top of the base coat using a reverse roll coater and this is gelled in an oven to 270° F.

Foam

| Ingredient | Parts by Weight |
|---|---|
| Exon 605 (Dispersion PVC Homopolymer Resin MW 80,400) | 1200 |
| Stauffer SCC-20 (Dispersion PVC Homopolymer Resin MW 114,000) | 500 |
| Geon 120 × 251 (PVC Homopolymer Resin) | 320 |
| Goodyear M-70 (Blending PVC Homopolymer Resin MW-81,100) | 700 |
| Drapex 4.4 (Octyl Epoxy Tallate) | 30 |
| DOP (Di-2-Ethylhexyl phthalate) | 1546 |
| T-3603 (Ba. Zn. Neodecanoate plus azodicarbonamide blowing agent) | 284 |
| LU-390 (Aluminum Silicate) | 350 |

The gelled foam is then printed with standard inks in the desired design on a Rotogravure Press. A standard ink formulation is as follows:

| Ingredient | Percent by Weight |
|---|---|
| Plastoprint Extender (5-Q-211) | 5.24 |
| Plastoprint Clay Extender (10-Q-948) | 5.24 |
| Plastoprint Solvent | 17.48 |
| Triton X-100 (Alkylated Acryl Polyether Alcohol) | 0.87 |
| Plastoprint Brown (80-Q-860) | 31.47 |
| Plastoprint Medium Chrome Yellow (20-Q-210) | 15.73 |
| Plastoprint Molybdate Orange (30-Q-149) | 19.23 |
| Polyethylene Wax Dispersion | 4.74 |

In the above formulation, the Plastoprint Solvent is a mixture of 77 percent by weight 2-nitropropane, 13 percent by weight diacetone alcohol and 10 percent by weight isopropyl acetate. The Plastoprint Extender is a solution of a poly(vinyl chloride - vinyl acetate) copolymer (between about 3 and 8 percent vinyl acetate) in Plastoprint Solvent and the Plastoprint Clay Extender is Plastoprint Extender containing about 30 percent by weight clay. All of the pigments are mixed with Plastoprint Extender; the Plastoprint Brown containing about 21 percent by weight molybdate orange and 4 percent by weight molybdate black; the Plastoprint Medium Chrome Yellow containing about 29.8 percent by weight medium chrome yellow; and the Plastoprint Molybdate Orange containing about 30 percent by weight molybdate orange.

Fourteen mils of a clear plastisol are applied using a reverse roll coater and then the decorative surface covering heated to 385° F. causing the blowing agent to decompose to foam the foam layer and to fuse the clear coat.

Clear Coat

| Ingredient | Parts by Weight |
|---|---|
| Tenneco 1742 (Disperion PVC Homopolymer Resin MW-120,000) | 1920.0 |
| Tenneco 521 (Poly(vinyl chloride - vinyl acetate) Copolymer Extender Resin MW-75,900, 95.5% vinyl chloride, 4.5% vinyl acetate | 1280.0 |
| Drapex 4.4 (Octyl Epoxy Tallate) | 160.0 |
| DOP (Di-2-Ethylhexyl phthalate) | 384.0 |
| TXIB (2-2-4 Trimethyl-1,3 Pentanediol Monoisobutyrate ester) | 160.0 |
| Nuostabe V-1060 (Ba, Cd, Zn Compound) | 96.0 |
| Nuopaz 1046 (2-2-4 Trimethyl-1,3 Pentanediol Monoisobutyrate ester) | 864.0 |

The release carrier is stripped from the product, and is utilized as a slip sheet with the product being wound on a seven-inch core in roll form.

EXAMPLE 2

A carrier is coated with a release coating and dried in the same manner as set forth in Example 1.

A reverse roll coater is used to apply seven mils of a plastisol base coat to the release carrier. This coating is then gelled in an oven to 290° F.

Base Coat

| Ingredient | Parts by Weight |
|---|---|
| Exon 6337 (PVC Homopolymer Dispersion Resin MW-141,000) | 400 |
| Blacar 1738 (PVC Homopolymer Dispersion Resin MW-233,000) | 1250 |
| Blacar 501 (PVC Homopolymer Blending Resin MW-95,300) | 1100 |
| DOP (di-2-Ethylhexyl phthalate) | 383 |
| TXIB (2-2-4 Trimethyl-1,3 Pentanediol Monoisobutyrate ester) | 383 |
| S-160 (Butyl-Benzyl Phthalate) | 205 |
| V-1366 (1% Ba., .8% Ca., .9% Zn, 5.4% P) | 77 |
| Pigment as required | |

The base coat is then coated with a very thin layer of a clear plastisol that is applied with a rotary screen printer.

Clear Plastisol

| Ingredient | Parts by Weight |
|---|---|
| Blacar 1732 (PVC Homopolymer Dispersion Resin) | 100 |
| DOP (di-2-ethylhexyl phthalate) | 32 |
| TXIB (2-2-4 Trimethyl-1,3 Pentanediol Monoisobutyrate ester) | 17 |
| M-275 (Organotin Stabilizer) | 2 |

A dry blend 28 mils thick is metered onto the wet plastisol coat and the dry blend is then sintered at 350° F.

Dry Blend

| Ingredient | Parts by Weight |
|---|---|
| Exon 9290 (PVC Homopolymer MW-83,900) | 250 |
| M-275 (Organotin Stabilizer) | 5 |
| DOP (Di-2-ethylhexyl phthalate) | 75 |
| Hi Sil 233 (Amorphous Hydrated Silicate) | 0.63 |

Foamable plastisol inks are printed into the sintered dry blend in the desired and those areas not printed are then printed with non-foamable plastisol inks using a Zimmer Printer. The inks are then gelled at 270° F.

The foamable ink contains 20.72 parts by weight paste and 400.00 parts by weight paste foamable ink.

| Foamable Ink | |
|---|---|
| Ingredient | Parts by Weight |
| Exon 605 (PVC Homopolymer Dispersion Resin MW-80,400) | 2000 |
| DOP (Di-2-ethylhexyl phthalate) | 900 |
| Drapex 4.4 (Octyl Epoxy Tallate) | 40 |
| ABC-18 (Organic Zinc Complex) | 60 |
| | 3000 |

| Paste | |
|---|---|
| Ingredient | Parts by Weight |
| Kempore AF (Azodicarbonamide) | 90.1 |
| DOP (Di-2-ethylhexyl phthalate) | 128.7 |
| | 218.8 |

| Non-Foamable Ink | |
|---|---|
| Ingredient | Parts by Weight |
| Blacar 1732 (PVC Homopolymer Dispersion Resin MW-106,000) | 2100 |
| DOP (Di-2-ethylhexyl phthalate) | 252 |
| S-711 ($C_7$–$C_9$–$C_{11}$ Mixture, Phthalates) | 630 |
| Synpron 744 (Ba. Zn. Phosphite Stabilizer) | 42 |
| | 3024 |

The structure is then coated with a clear plastisol using a reverse roll coater and heated to 385° F. to fuse the resins and expand the pattern in the areas printed with the foamable inks.

| Clear Plastisol | |
|---|---|
| Ingredient | Parts by Weight |
| Exon 6337 (PVC Homopolymer Dispersion Resin MW-141,000) | 550 |
| Blacar 1738 (PVC Homopolymer Dispersion Resin MW-233,000) | 1360 |
| Blacar 501 (PVC Homopolymer Blending Resin MW-95,300) | 816 |
| DOP (Di-2-ethylhexyl phthalate) | 550 |
| TXIB (2-2-4 Trimethyl-1,3 Pentanediol Monoisobutyrate ester) | 408 |
| S-160 (Butyl Benzyl phthalate) | 217 |
| Synpron 744 (Ba. Zn. Phosphite Stabilizer | 81.6 |

The release carrier is stripped from the product and can be utilized as a slip sheet when rolling up the product.

The following tables report the amounts the decorative layers are stretched and the backing layers compressed while in roll form and the change in dimensions of the surface covering on unrolling. Table I shows measurements for the decorative surface covering produced in accordance with Example 1 and Table II shows measurements for the decorative surface covering produced in accordance with Example 2. Measurements were made lengthwise on the respective surface coverings.

TABLE I

| Date | Time | Elapsed Time After Unroll | Wear Layer 18 Inch Mark | Wear Layer 46 Inch Mark | Backing 18 Inch Mark | Backing 46 Inch Mark |
|---|---|---|---|---|---|---|
| Initial Marks | | | 17.997 | 45.996 | 18.000 | 45.999 |

TABLE I-continued

| Date | Time | Elapsed Time After Unroll | Wear Layer 18 Inch Mark | Wear Layer 46 Inch Mark | Backing 18 Inch Mark | Backing 46 Inch Mark |
|---|---|---|---|---|---|---|
| Measurement on Core. Unrolled | | | 18.266 | | 17.749 | |
| 7-3-74 | 8:36 | 1 min. | 18.050 | 46.073 | 18.042 | 46.070 |
| | 8:40 | 5 min. | 18.038 | 46.053 | 18.032 | 46.049 |
| | 8:50 | 15 min. | 18.032 | 46.038 | 18.026 | 46.036 |
| | 9:05 | 30 min. | 18.028 | 46.030 | 18.025 | 46.033 |
| | 9:35 | 1 hr. | 18.025 | 46.020 | 18.022 | 46.024 |
| | 10:35 | 2 hr. | 18.023 | 46.020 | 18.020 | 46.021 |
| | 1:35 | 5 hr. | 18.022 | 46.017 | 18.019 | 46.019 |
| 7-8-74 | 11:35 | 123 hr. | 18.004 | 45.986 | 18.000 | 45.983 |
| 7-16-74 | 8:35 | 312 hr. | 18.001 | 45.975 | 17.998 | 45.979 |
| 7-22-74 | 8:35 | 456 hr. | 17.996 | 45.961 | 17.991 | 45.962 |

TABLE II

| Date | Time | Elapsed Time After Unroll | Wear Layer 18 Inch Mark | Wear Layer 46 Inch Mark | Backing 18 Inch Mark | Backing 46 Inch Mark |
|---|---|---|---|---|---|---|
| Initial Marks | | | 18.000 | 45.998 | 17.999 | 46.000 |
| Measurement on Core. Unrolled | | | 18.219 | | 17.792 | |
| 7-3-74 | 8:54 | 1 min. | 18.022 | 46.041 | 18.027 | 46.048 |
| | 8:58 | 5 min. | 18.020 | 46.035 | 18.023 | 46.048 |
| | 9:08 | 15 min. | 18.017 | 46.028 | 18.020 | 46.036 |
| | 9:23 | 30 min. | 18.016 | 46.026 | 18.018 | 46.030 |
| | 9:53 | 1 hr. | 18.014 | 46.022 | 18.017 | 46.028 |
| | 10:53 | 2 hr. | 18.013 | 46.022 | 18.015 | 46.023 |
| | 1:53 | 5 hr. | 18.010 | 46.018 | 18.012 | 46.019 |
| 7-8-74 | 11:53 | 123 hr. | 18.002 | 45.994 | 18.000 | 45.990 |
| 7-16-74 | 8:53 | 312 hr. | 18.006 | 46.003 | 18.005 | 46.004 |
| 7-22-74 | 8:53 | 456 hr. | 18.001 | 46.000 | 18.000 | 45.994 |

When floors produced in accordance with Examples 1 and 2 were unrolled and installed over a wooden subfloor and before the sheets could substantially return to their original dimensions, by stapling the sheets at their peripheries to the subfloor, the sheets remained taut and flat even in a fluctuating environment.

When sheet flooring produced in accordance with Examples 1 and 2 was rolled inside out, that is with the decorative layers facing inwardly in the roll, the sheets grew on unrolling and buckled in a fluctuating environment when installed by securing the sheets at their peripheries over a wooden subfloor.

As indicated above, the release carrier is stripped from the product, and is utilized as a slip sheet with the product being wound on a seven-inch core in roll form. The carrier is basically nothing more than a paper that has been provided with a release coating. The essence of the invention herein is the apparatus and technique for removing the carrier from the flooring product in such a manner that the flooring product, minus its carrier, may relieve itself of some unusual stresses whereby it will then be rolled up and provided with a uniform stress. Should the product be handled, or the carrier be removed in a condition that causes stress in the flooring product and these stresses are not fully relieved by the time the flooring product reaches the roll, the flooring product will have a resultant stress which is the stress designed to occur due to the rolling of the product plus any of the stresses built into the product due to its handling and paper carrier stripping techniques. This resultant stress may not be a uniform controlled stress in the finished product to permit the finished product to carry out its intended purpose.

Referring now to FIG. 1, there is shown the apparatus which grips the carrier and handles the flooring product so that a controlled stress is developed when the flooring product is wound up. The flooring product with the carrier 2 is pulled to the wind-up area by conventional pull rolls 4 and 6. The flooring product with carrier 2 now has to move only approximately a distance of 20 feet to the wind-up stand, and during this time, it should be held in basically a flat condition so that no stresses are developed in the product due to the curving of the product, and the product should be moved this last 20 feet without the product itself unsupported by the carrier being subjected to tensile stresses which will prestress the product. The paper carrier must be removed from the floor product, yet the paper carrier still must function as being the means that moves the flooring so that the flooring itself is not subjected to tensile stresses. That is, the floor product itself must not be the means that is used to pull the flooring from the pull rolls to the wind-up stand. The paper carrier must be the means used to convey the flooring from the pull rolls to the wind-up stand so that the flooring minus carrier is maintained in a relatively stress-free condition. The flooring 2 must also be maintained in a relatively level plane so that it will be able to relieve itself of unusual stresses. The flooring 2 is initially moved over a small roll 8 so that it is placed in a horizontal plane. The flooring 2 then moves on to the three-roll structure 10, which is an accumulator and stripping assembly. The flooring 2 passes over roll 12 and the paper carrier 14 is stripped from the back of the flooring 20 at that point. The paper carrier passes around a roll 16 which is mounted for vertical movement. The paper 14 then passes on to roll 18 where it then contacts, but does not engage, the back of the flooring (minus carrier) 20. The flooring 20 and the paper then move into the wind-up stand which winds the flooring 20 and paper up into roll 22. The vertically movable roll 16, which is a dip roll or accumulator roll, is critical from two points of view. One, it maintains a tension upon the paper 14 so that the paper may be wound up as a slip sheet or a layer between the layers of flooring 20 on the roll 22. This then prevents the back surface of the flooring 20 from sticking to or marring the front surface of the flooring 20 in the roll 22. The paper also provides support to the roll if the roll is stacked up on end. It is important that the paper be fed in between the layers of flooring 20 without wrinkles. This is accomplished by keeping a slight tension through roll 16 on the paper 14. In addition, roll 16 tends to accumulate the excess paper generated so that the paper is really the means pulling the flooring 20 to the wind-up roll. From the point that the paper is stripped from the back of the flooring, the paper may contact the back of the flooring again, but is not affixed or engaged thereto. The paper which is fed in between the layer of flooring 20 is gripped thereby and applies a force tending to pull the flooring 20 towards the wind-up stand. Up to the point of roll 12, the paper carrier 14 is attached to the flooring and the pulling of the paper will pull the flooring from the pull rolls towards roll 12. At roll 12, the engagement between the paper carrier and flooring 20 cease. However, due to the accumulator roll 16 maintaining tension on the paper, and the fact that the paper is fastened to the roll being wound up, the paper still functions as the means pulling the flooring to point 12, and the bulk of the stress on the flooring from roll 12 to wind-up roll 22 is absorbed by the paper carrier 14. Thus, flooring 20 may be subjected to a slight tension force, but basically, the flooring 20 from roll 12 to wind-up roll 22 is in a condition that does not add stresses to the flooring and any unusual stresses which have developed in the floor due to the manufacturing of the floor up to this point are permitted to relieve themselves. The flooring is unsupported as it moves from roll 12 to 18 and will stress relieve itself some at that point. From roll 18 to the wind-up roll 22, the flooring 20 rests upon the paper carrier 14 and is basically, through frictional contact, conveyed to the wind-up roll 22. Therefore, little tension force is applied to the flooring 20, and it approaches the wind-up roll 22 in virtually a tension-free state so that a uniform stress is developed in the flooring as it is wound about the wind-up roll 22. Therefore, as indicated above, the flooring is provided with its stretched outer surface and compressed back surface.

It should be realized that the radius of the paper in the wind-up roll is always less than the radius of the flooring and, therefore, paper will be accumulated, and the vertical mounting of roll 16 provides for the absorbing of this accumulated paper and maintains the required tension on the paper, as indicated above. It should also be noted that the flooring has been maintained in a relatively flat plane and that stripping of the paper is carried out while the flooring is in a relatively flat plane so that the flooring has not been provided with some unusual stresses therein such as would exist if it had just been removed from around the surface of a roll. It should be noted that the flooring product is subject to the development of stresses as it moves around different rolls. Consequently, prior to the time that the final roll-up of the flooring is carried out at roll 22, the flooring material 20 should be kept in a relatively flat plane so that no unusual stresses are developed in the flooring. Stripping must be carried out with the flooring maintained in a flat plane, and the stripping should be carried out after the flooring has been left in a flat plane for a time before stripping of the paper carrier is carried out. Finally, the flooring must be moved without its backing in a relatively tension-free state from the point of stripping to its wind-up roll so that the flooring is not subjected to an unusual amount of tension stresses.

What is claimed is:

1. An apparatus for stripping the carrier from the back of a floor product and moving the floor product in a substantially non-stress applying condition so that the application of additional stresses is avoided, and winding the floor product in a roll comprising:

(a) a means for pulling the floor product attached to a carrier to a point short of its wind-up in a roll;

(b) a roll means placing the floor product with its carrier in a relatively flat condition;

(c) a three-roll structure having the two outside rolls with their upper surface in the same plane as the floor product in its flat condition whereby the floor product moves from the first outside roll to the second outside roll with the carrier stripped from the floor product as it moves from the first outside roll to the second outside roll;

(d) positioned between said two outside rolls there being a movably mounted third roll means positioned to accumulate excess carrier material and to maintain a stress on the carrier material as it moves from the first outside roll at which stripping is carried out to the point where the floor product and carrier are wound together in a roll;

(e) said second outside roll means moving the carrier back into contact with the floor product, but not attached thereto, so as to support the floor product minus its carrier in a relatively non-stress applying condition, and (f) means wrapping both the floor product and its unattached carrier in a roll.

2. The method of winding a floor product in a controlled pre-stressed condition wherein the floor product is designed to be rolled up so that the outer surface of the floor product is stretched and the back surface of the floor product is compressed, the steps comprising:

(a) moving the floor product on a carrier and attached thereto to a point prior to the winding up of the floor product into a roll where the floor product is not attached to its carrier;

(b) placing the floor product with its carrier attached thereto in a flat condition;

(c) removing the carrier from attachment with the floor product;

(d) moving the floor product in a flat, tension-free condition from the point where the carrier is detached from the floor product to where the floor product is wound up so that the excessive stresses within the floor product may relieve themselves, and the application of additional stresses is avoided;

(e) moving the carrier back into contact, but not attachment, to the floor product so that the carrier will function as a means for separating the surfaces of the floor product when it is wound up in a roll and also as a means for conveying the floor product from the point where it is detached from the carrier to the wind-up point in a relatively non-stress applying condition; and (f) winding up the floor product so that only a uniform winding stress is developed in the floor product as it is wound up.

* * * * *